US008015661B2

(12) United States Patent
Baer et al.

(10) Patent No.: US 8,015,661 B2
(45) Date of Patent: Sep. 13, 2011

(54) VACUUM WITH RECHARGEABLE BATTERY

(75) Inventors: Mark E. Baer, Trout Run, PA (US); Li H. Liu, South Williamsport, PA (US); Jonathan Miller, Williamsport, PA (US)

(73) Assignee: Shop Vac Corporation, Williamsport, PA (US)

( * ) Notice: Subject to any disclaimer, the term of this patent is extended or adjusted under 35 U.S.C. 154(b) by 1540 days.

(21) Appl. No.: 11/007,414

(22) Filed: Dec. 8, 2004

(65) Prior Publication Data

US 2005/0155177 A1 Jul. 21, 2005

Related U.S. Application Data

(60) Provisional application No. 60/527,874, filed on Dec. 8, 2003, provisional application No. 60/546,159, filed on Feb. 20, 2004.

(51) Int. Cl.
*A47L 9/10* (2006.01)

(52) U.S. Cl. ..... 15/353; 15/327.5; 15/328

(58) Field of Classification Search ..... 15/327.5, 15/328, 353
See application file for complete search history.

(56) References Cited

U.S. PATENT DOCUMENTS

| | | | |
|---|---|---|---|
| 1,487,424 | A | 3/1924 | Ahlgren |
| 1,539,119 | A | 5/1925 | Johnson |
| 1,546,648 | A | 7/1925 | Glidden et al. |
| 2,232,415 | A | 2/1941 | Talbot et al. |
| D201,083 | S | 5/1965 | Roth |
| 3,858,272 | A | 1/1975 | Bard et al. |
| 3,871,924 | A | 3/1975 | DeMattie et al. |
| 4,325,163 | A | 4/1982 | Mattson et al. |
| D269,088 | S | 5/1983 | Genaro et al. |
| 4,591,777 | A | 5/1986 | McCarty et al. |
| D290,119 | S | 6/1987 | Trezise et al. |
| 4,734,017 | A | 3/1988 | Levin |
| 4,797,072 | A | 1/1989 | Berfield et al. |
| 4,836,753 | A | 6/1989 | Berfield et al. |
| 4,884,314 | A | 12/1989 | Miner et al. |
| 4,945,604 | A | 8/1990 | Miner et al. |
| 4,961,246 | A | 10/1990 | Hauge et al. |

(Continued)

FOREIGN PATENT DOCUMENTS

| | | |
|---|---|---|
| EP | 0783863 | 7/1997 |

(Continued)

OTHER PUBLICATIONS

International Search Report in Application No. PCT/US2004/040994, dated Mar. 23, 2005.

(Continued)

*Primary Examiner* — Joseph J Hail
*Assistant Examiner* — Shantese McDonald
(74) *Attorney, Agent, or Firm* — Marshall, Gerstein & Borun LLP; Richard M. LaBarge; Robert M. Gerstein

(57) ABSTRACT

A vacuum cleaner includes a tank having a bottom and an inlet for receiving debris, a motor assembly disposed adjacent to the tank, the motor assembly adapted to draw debris into the tank through the inlet, a battery pack disposed adjacent the bottom of the tank, and a connection from the battery pack to the motor assembly that is adapted to carry current between the battery pack and the motor assembly. The battery pack includes at least one battery and supplies power to the motor assembly.

11 Claims, 16 Drawing Sheets

U.S. PATENT DOCUMENTS

| | | | | |
|---|---|---|---|---|
| 5,014,388 | A | 5/1991 | Schiazza et al. | |
| 5,289,605 | A | 3/1994 | Armbruster | |
| 5,294,063 | A | 3/1994 | Bote | |
| 5,606,769 | A | 3/1997 | Tomasiak et al. | |
| 5,607,794 | A | 3/1997 | Koenig | |
| 5,611,107 | A | 3/1997 | Tomasiak et al. | |
| 5,765,258 | A | 6/1998 | Melito et al. | |
| 5,829,095 | A * | 11/1998 | Legatt et al. | 15/412 |
| D405,413 | S | 2/1999 | Segers | |
| D406,258 | S | 3/1999 | Segers | |
| 6,006,400 | A | 12/1999 | Presenza | |
| 6,033,800 | A | 3/2000 | Ichiyanagi et al. | |
| D424,013 | S | 5/2000 | Curtis | |
| 6,055,700 | A | 5/2000 | Holsten et al. | |
| 6,065,182 | A | 5/2000 | Wright et al. | |
| 6,066,211 | A | 5/2000 | Sandell | |
| D432,493 | S | 10/2000 | Killebrew et al. | |
| D436,918 | S | 1/2001 | Matsuda | |
| D444,125 | S | 6/2001 | Shy | |
| 6,295,692 | B1 * | 10/2001 | Shideler | 15/327.5 |
| 6,448,732 | B1 | 9/2002 | Block | |
| 6,530,117 | B2 * | 3/2003 | Peterson | 15/353 |
| D473,234 | S | 4/2003 | Hussaini et al. | |
| 6,553,612 | B1 | 4/2003 | Dyson et al. | |
| D484,852 | S | 1/2004 | James et al. | |
| D486,446 | S | 2/2004 | Hriscu et al. | |
| D492,248 | S | 6/2004 | Gregory et al. | |
| D492,649 | S | 7/2004 | Resch et al. | |
| D508,018 | S | 8/2005 | Yokota | |
| 2002/0108205 | A1 | 8/2002 | Berfield et al. | |
| 2002/0189048 | A1 | 12/2002 | Maruyama et al. | |
| 2003/0134189 | A1 | 7/2003 | Kanai et al. | |
| 2003/0182758 | A1 | 10/2003 | Hisano et al. | |
| 2004/0088817 | A1 * | 5/2004 | Cochran et al. | 15/327.5 |

FOREIGN PATENT DOCUMENTS

| | | |
|---|---|---|
| FR | 2 690 328 | 10/1993 |
| FR | 2690328 | * 10/1993 |
| FR | 2792519 | 10/2000 |
| JP | 01-209038 | 8/1989 |
| JP | 02-200230 | 8/1990 |
| JP | 2001-321310 | 11/2001 |
| JP | 2002-34872 | 8/2003 |
| WO | WO-00/38026 | 6/2000 |
| WO | WO-03/090596 | 11/2003 |

OTHER PUBLICATIONS

Written Opinion of the International Searching Authority, dated Mar. 23, 2005.

European Opposition filed in corresponding European application No. 04813324.3, dated Dec. 1, 2010.

* cited by examiner

VACUUM WITH RECHARGEABLE BATTERY

CROSS REFERENCE TO RELATED APPLICATIONS

This application claims priority to U.S. Provisional Application No. 60/527,874, filed on Dec. 8, 2003 and U.S. Provisional Application No. 60/546,159, filed on Feb. 20, 2004.

FIELD OF THE DISCLOSURE

The present disclosure relates to a vacuum apparatus, and more specifically, to a vacuum with a rechargeable battery.

BACKGROUND OF THE DISCLOSURE

Vacuum cleaners for industrial environments and outdoor use generally include a holding tank on top of which is disposed a motor assembly. An air inlet can be disposed in the side of the tank with a hose connected to the air inlet. The motor assembly includes a housing inside of which is disposed an electric motor connected to an air impeller. When energized, the electric motor spins the impeller to create a low pressure area within the tank. Air is drawn into the tank through the hose and inlet in the side of the tank and up to the impeller. The air is then pushed through the motor housing and exhausted to the atmosphere. Debris pulled into the tank through the hose is kept inside the tank by placing a filter between the motor assembly and the tank.

The electric motor is usually an AC motor that is supplied current by a cord plugged into a standard electrical outlet. The cord provides a generally constant source of electric current. However, the user is limited in the area that can be vacuumed by the length of the cord. Further, the cord can be unwieldy and must be maintained with the vacuum. The longer the cord, the more unwieldy it is. Thus, the manufacturer must balance the needs for a large range of use with the impracticalities of having a long cord.

Figure 1:
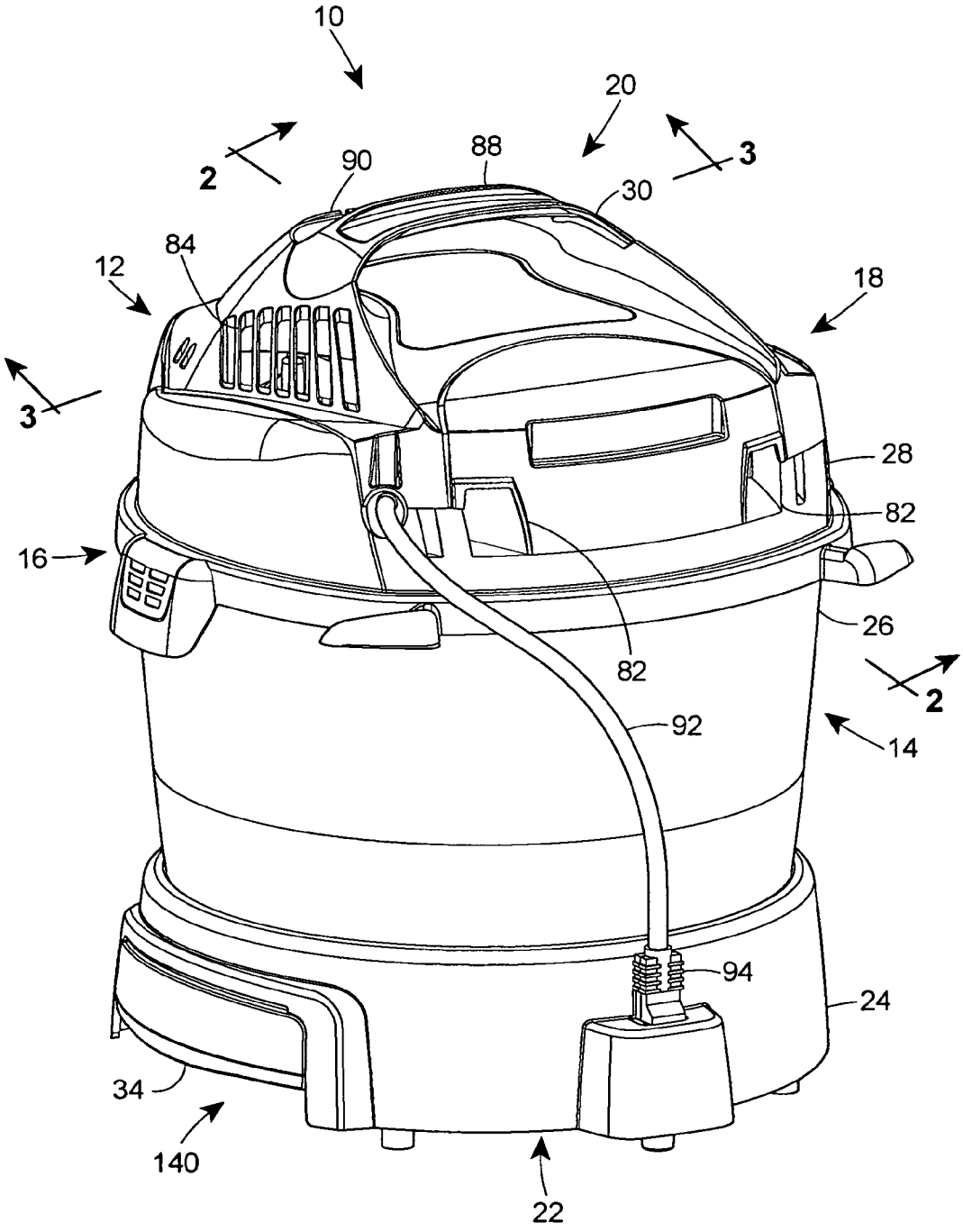
FIG. 1 is a perspective view of a vacuum cleaner that includes a motor assembly and a detachable battery pack.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Figure 2:
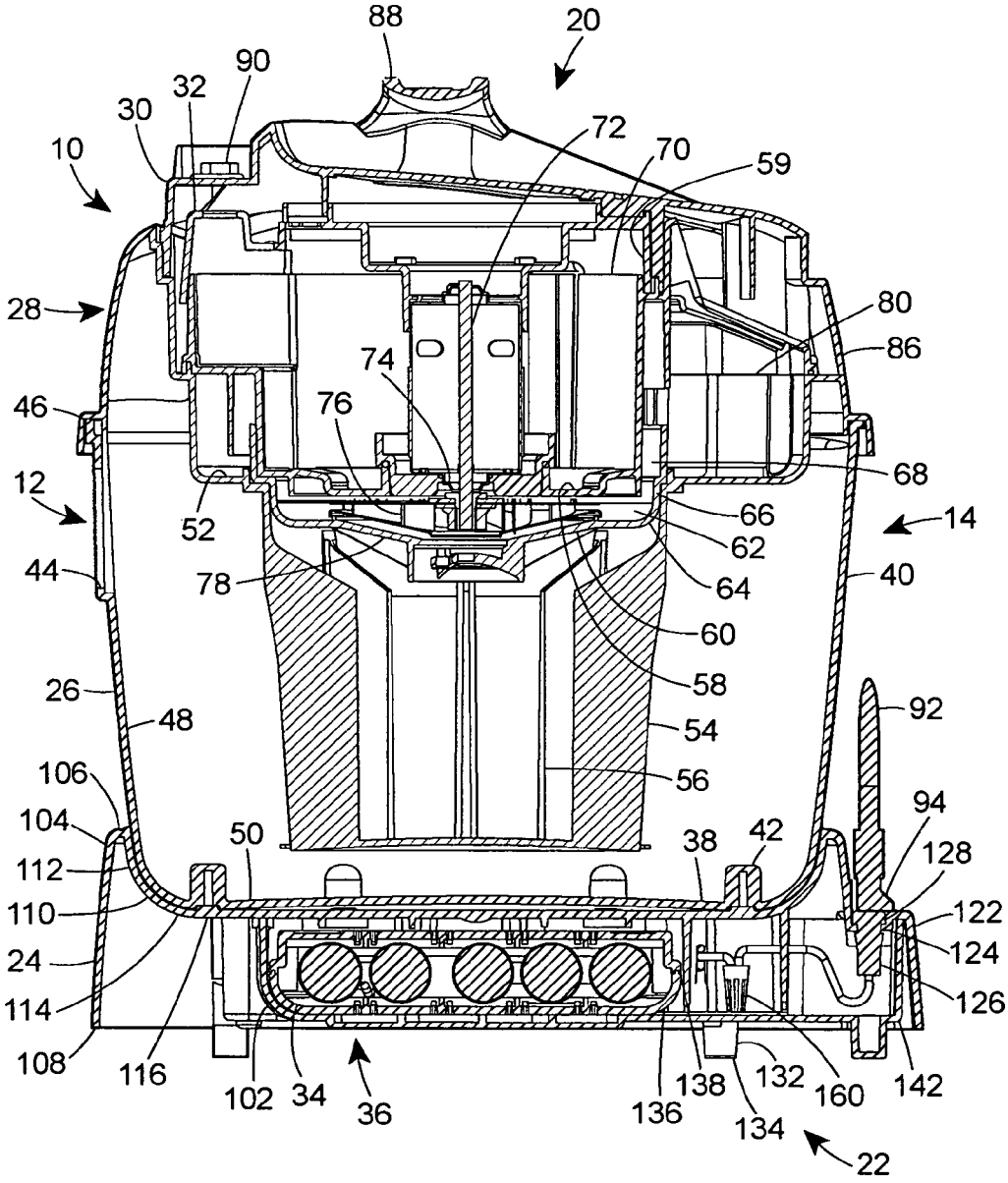
FIG. 2 is a section view of the vacuum of FIG. 1 taken along line 2-2 in FIG. 1.

Referring now to the drawings, and in particular to FIGS. 1 and 2, a vacuum cleaner 10 is depicted. The vacuum cleaner 10 has a front side 12, a back side 14, a left side 16, a right side 18, a top side 20, and a bottom side 22. These labels are for convenience of description only, and no limitation shall be read therein. The vacuum cleaner 10 includes a base 24, a receiving tank 26 disposed on the base 24, and a lid assembly 28 disposed on the receiving tank 26 that includes a cover 30. Casters or wheels (not depicted) may be attached to the base 24 to make the vacuum cleaner 10 easier to move. The vacuum cleaner 10 further includes a motor assembly 32 disposed in the lid assembly 28 and under the cover 30, and a battery pack 34 releasably disposed in the base 24. The motor assembly 32 and the battery pack 34 define at least a portion of a blower assembly 36.

Figure 3:
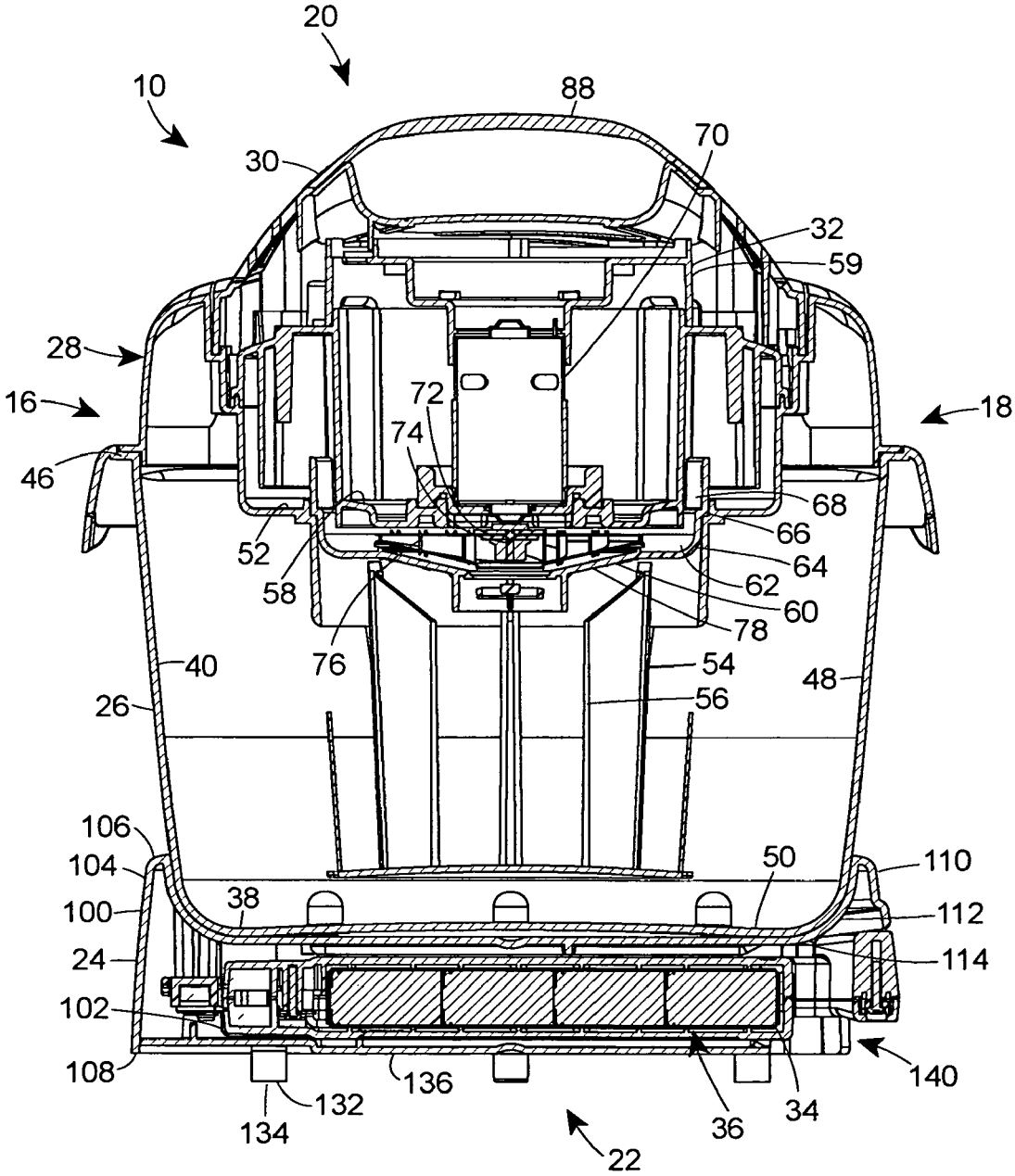
FIG. 3 is a section view of the vacuum of FIG. 1 taken along line 3-3 in FIG. 1.

Referring now to FIGS. 2 and 3, the tank 26 includes a bottom wall 38 and a side wall 40 extending up from the bottom wall 36. A series of bosses 42 can extend up from the bottom wall 38 to accommodate the attachment of the base 24 to the tank 26 as will be described later. In this example, the side wall 40 is generally circular, but other shapes can be used, such as a side wall 40 that is rectangular with four panels. The tank 26 as shown defines an interior volume of 2.5 gallons, but any useful size can be employed. Disposed in the side wall 40 is an inlet 44. The inlet 44 is an opening in the side wall 40 to which a hose (not shown) can be attached. The hose can be used, as is known, to direct the debris into the tank 26 when the motor is running. The top of the side wall 40 defines a rim 46.

The tank 26 has an inner surface 48 defined in part by a bottom inner surface 50. The bottom inner surface 50 is defined as the part of the tank 26 against which the debris or liquid gathered into the tank 26 by the vacuum 10 settles due to the force of gravity. In the example shown in FIG. 2, a majority of the bottom inner surface 50 is defined by the bottom wall 38, however, in other examples, a portion of the bottom inner surface 50 may be defined by caster supports, rims, legs or other structure.

The lid assembly 28 is disposed on the rim 46 of the tank 26. The lid assembly 28 includes a lid 52 that is constructed to attach the motor assembly 32 to the lid assembly 28. The lid 52 may be formed integrally with a filter cage 54 that extends down into the tank 26. A filter 56 is placed on the filter cage 54 to ensure that debris pulled into the tank 26 through the hose is maintained in the tank 26, and no debris, i.e. only air, flows into and through the motor assembly 32. A variety of filter types can be used, including foam, cartridge filters and cloth disks.

The motor assembly 32, disposed on the lid 52, includes a lower motor housing 58 and a grid plate 60 spaced downward from the lower motor housing 58. An upper motor housing 59 is located above the motor but under the cover 30. An impeller chamber 62 is disposed in the space between the lower motor housing 58 and the grid plate 60. The grid plate 60 includes an outer edge 64 which is radially outward from the lower motor housing 58. Sidewalls 66 extend upward from the outer edge 64 radially outward from the motor housing 58. The space between the sidewalls 66 and the motor housing 58 defines an annular chamber 68.

The lower motor housing 58 can be disposed on the motor mount 52 using any construction known in the art. In the embodiment shown in FIGS. 1-13, the motor assembly 32 is relatively permanently fixed to the rest of the lid assembly 28. However, as is known in the art, a detachable blower can be used to create a vacuum within the tank 26 and also be removed to be used as a hand held blower or vacuum as more fully described below. A DC motor 70 is maintained within the motor housing 58. While a DC motor 70 is shown, a universal type motor can also be used. A shaft 72 extends down from the motor 70, and out of the motor housing 58 through an aperture 74 in the housing 58. An impeller 76 is disposed on the end of the shaft 72 in the impeller chamber 62. The grid plate 60 includes a grated portion 78, such that air can pass freely from outside the motor assembly 32 through the grated portion 78 and into the impeller chamber 62.

The lid assembly 28 and the cover 30 define a blower chamber 80 on the back side 16 of the vacuum cleaner 10. The blower chamber 80 receives air that has been discharged by the impeller 76. The air can then be directed out slots 82 in the lid 24 on the back side 14 (shown in FIG. 1). Vents 84 in the cover 30 on the top side 20 of the vacuum cleaner 10 are provided for the intake and exhaust of cooling air for the motor 70 or can also provide exhaust for the working air from the air impeller 76. In a still further design, the air can escape out a port 86 in either the lid 24 or the cover 30 on the back side 14. In this design, a hose can be attached to the port 86 such that the vacuum cleaner 10 can direct a stream of air and function as a blower.

The lid assembly 28 includes at least one handle 88 that can be used to lift and carry the vacuum cleaner 10. An on/off switch 90 is disposed on the lid assembly 28 and a power cord 92 extends at a first end from the motor assembly 32 to a plug 94 at a second end. As will be described herein, the DC motor 70 and the battery pack 34 are in electrical communication, and the on/off switch selectively allows current to flow from the battery pack 34 to the motor 70 and to cut any supply of current to the motor 70, i.e. to turn the DC motor 70 on and off and thus the vacuum 10 on and off. The power cord 92 can be sized to a length such that there is a relatively small amount of slack in the power cord 92 between the motor assembly 32 and the battery pack 34. The power cord 92 can also be coiled to take up any slack. The tank 26 can include recesses (not shown) within which the power cord 92 can be secured.

Figure 4:
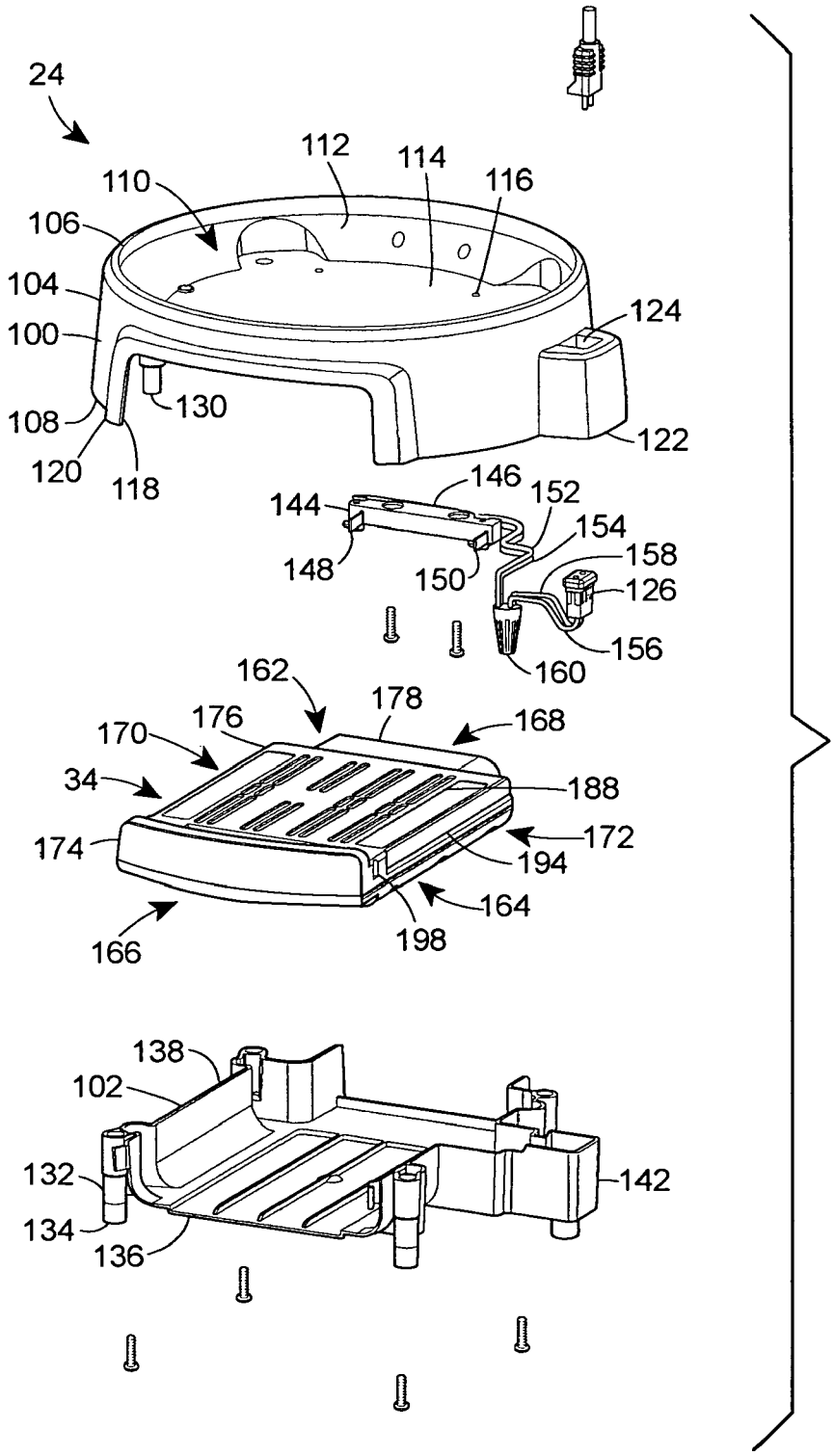
FIG. 4 is an exploded view of the base of the vacuum, including the battery pack.
Figure 5:
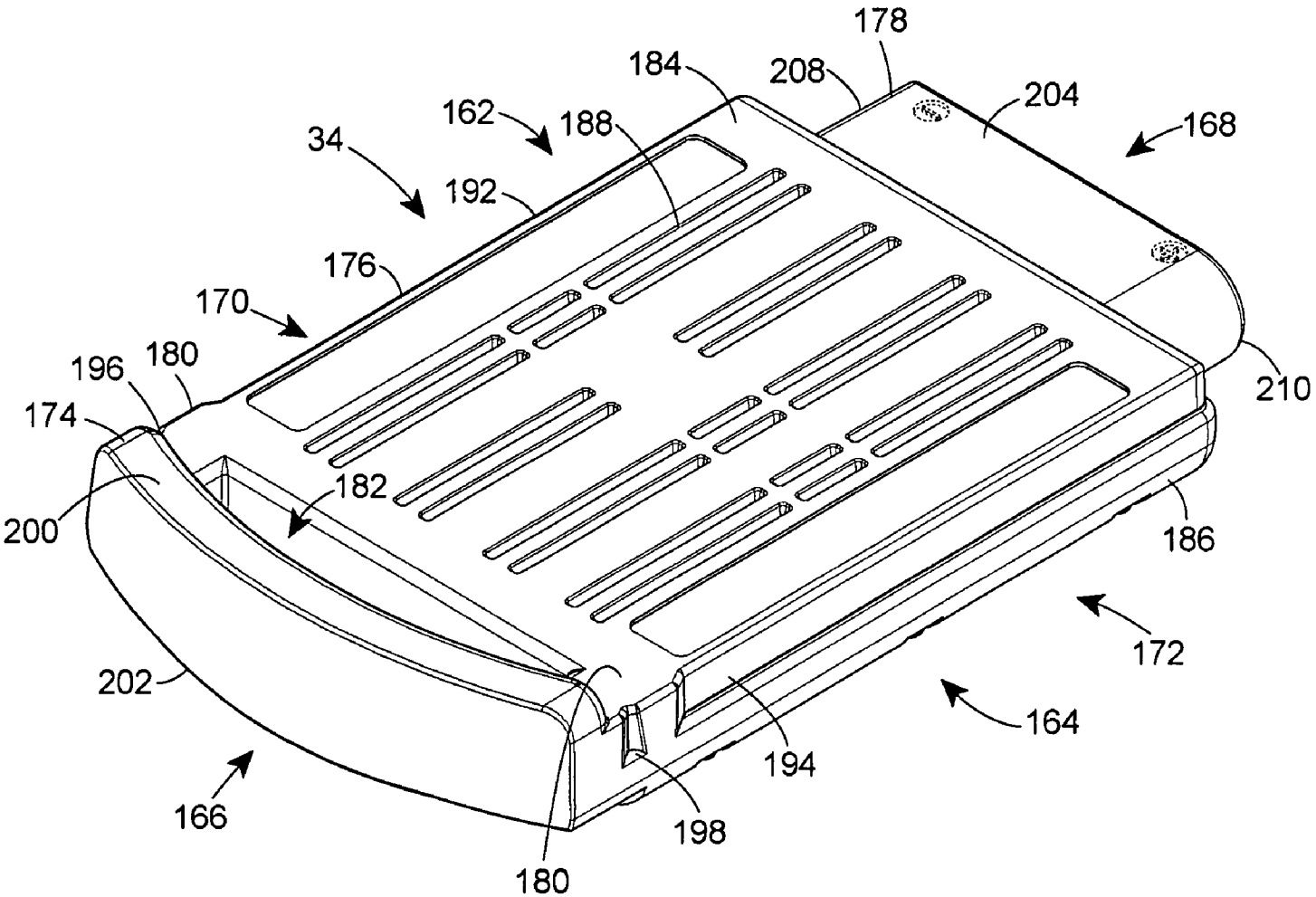
FIG. 5 is a perspective view of the battery pack.
Figure 6:
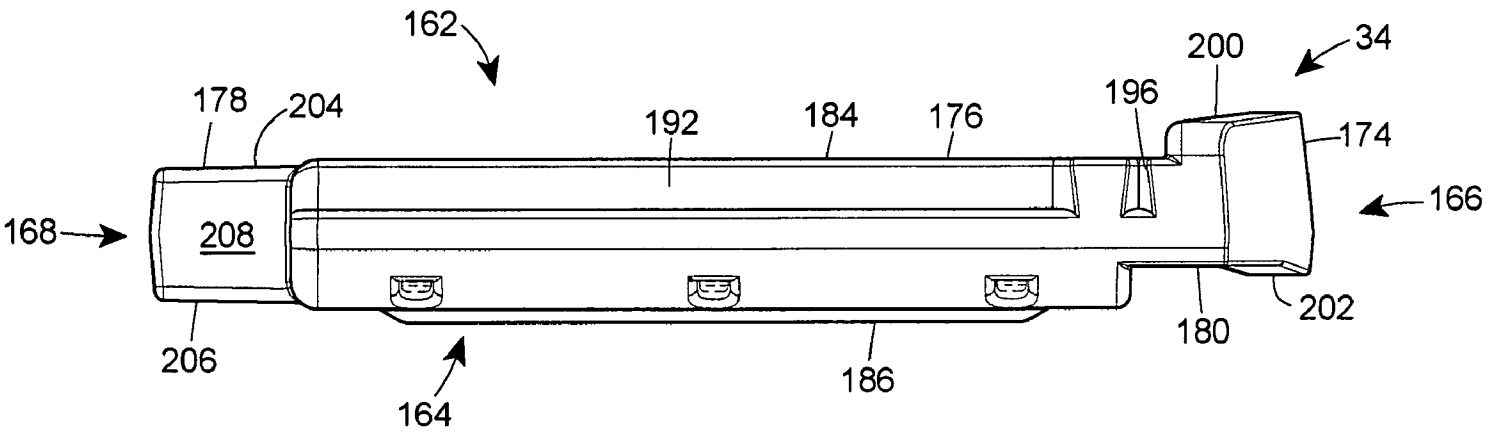
FIG. 6 is a left side view of the battery pack.
Figure 7:
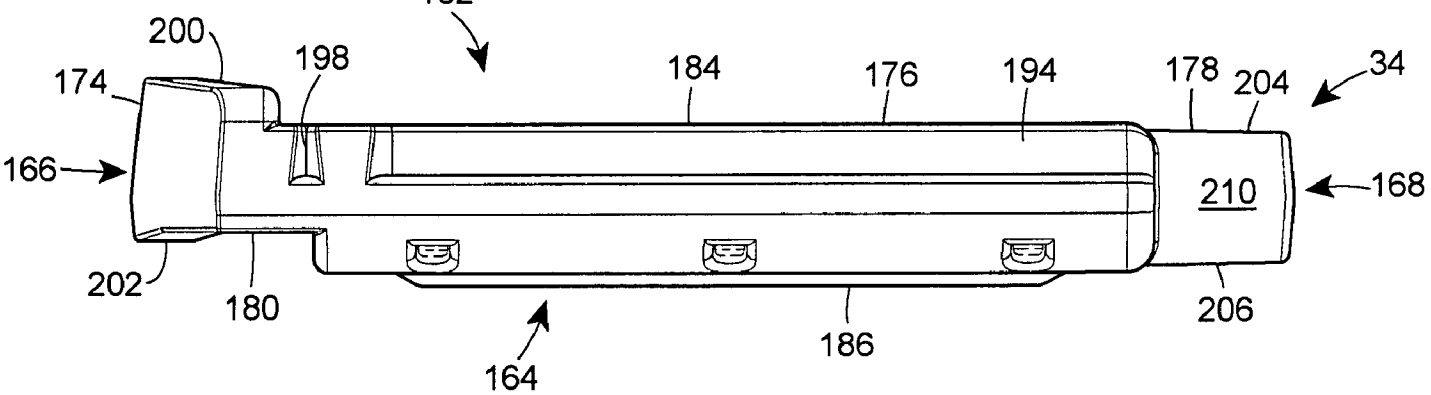
FIG. 7 is a right side view of the battery pack.
Figure 8:
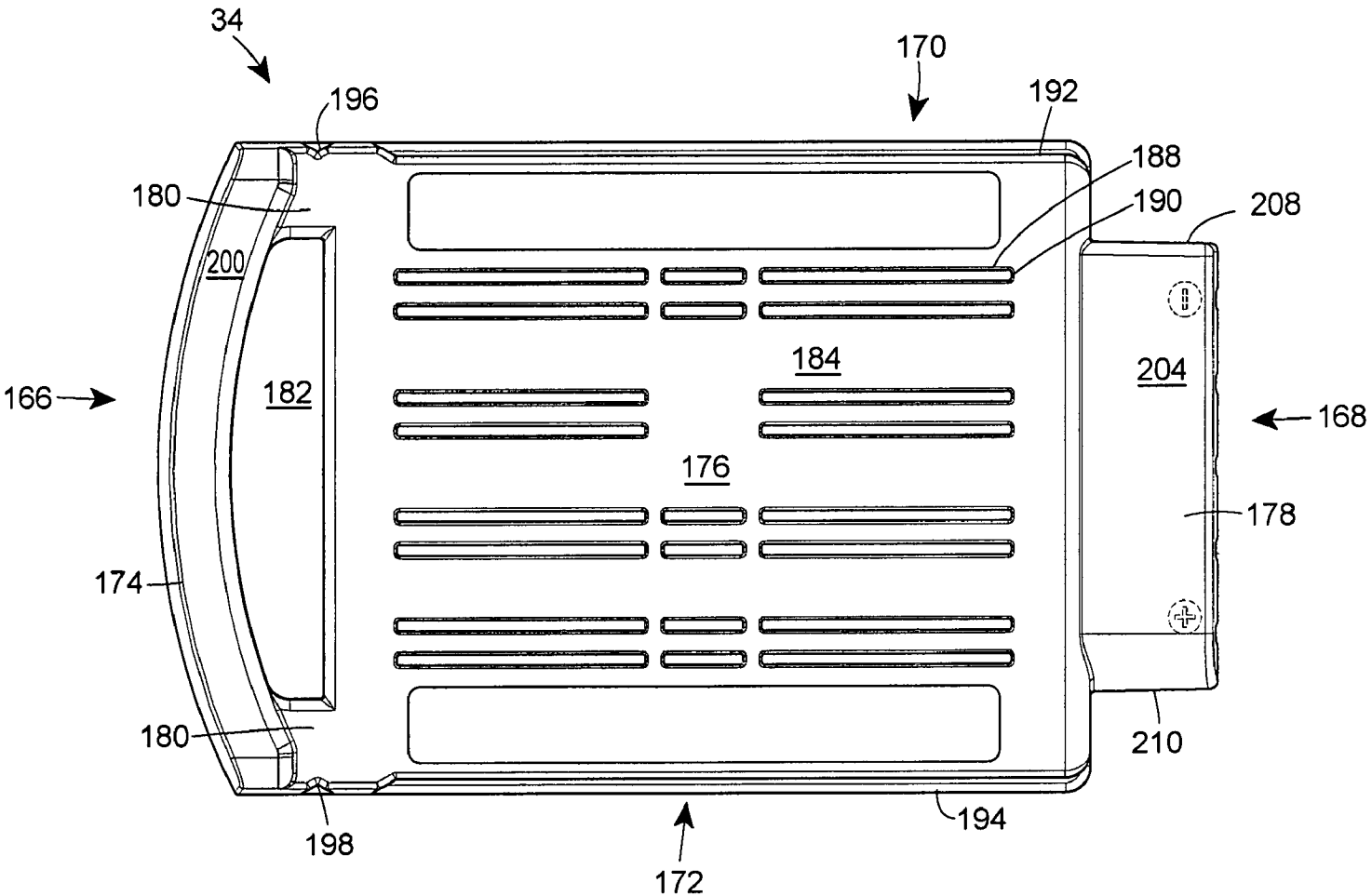
FIG. 8 is a top side view of the battery pack.
Figure 9:
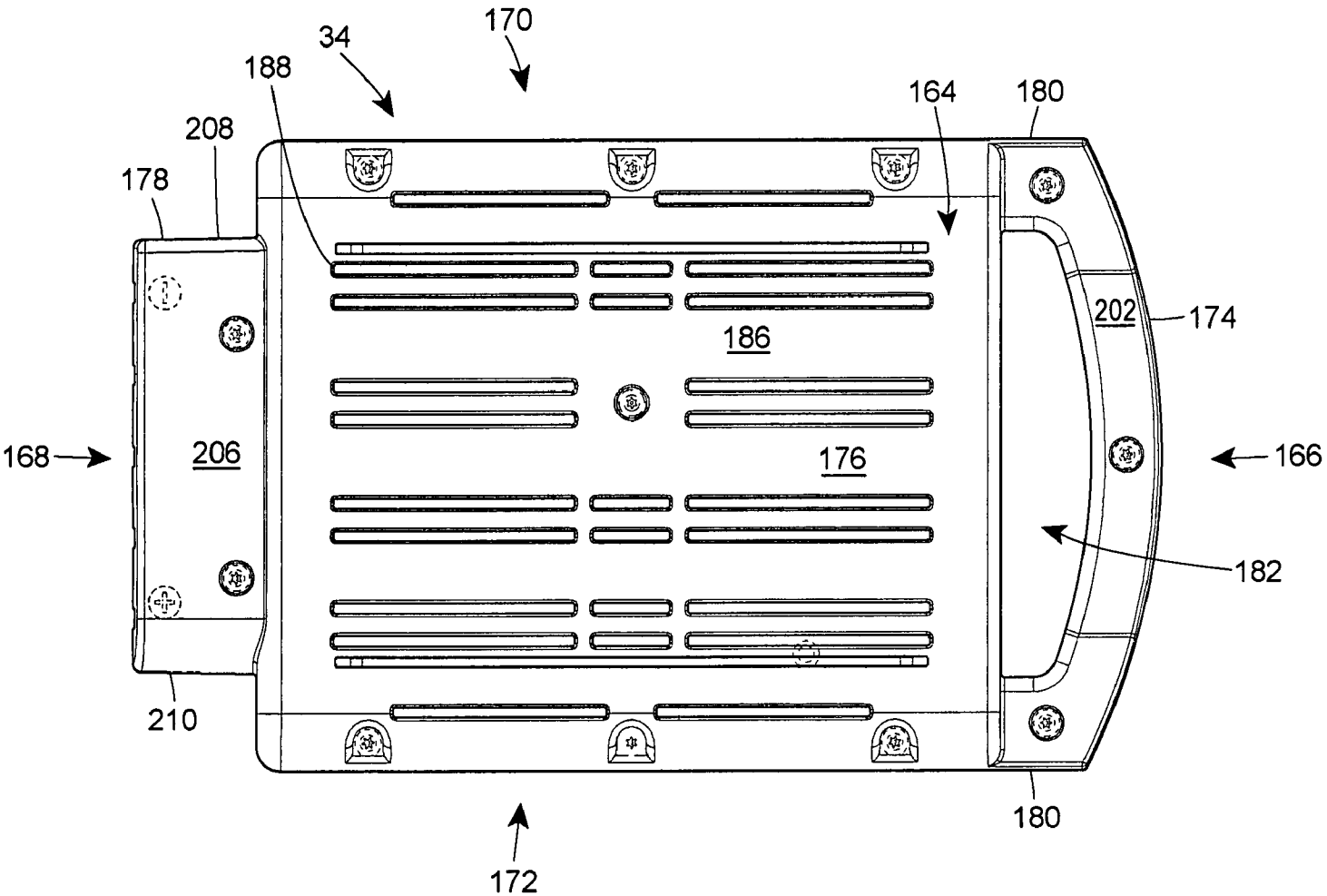
FIG. 9 is a bottom side view of the battery pack.
Figure 10:
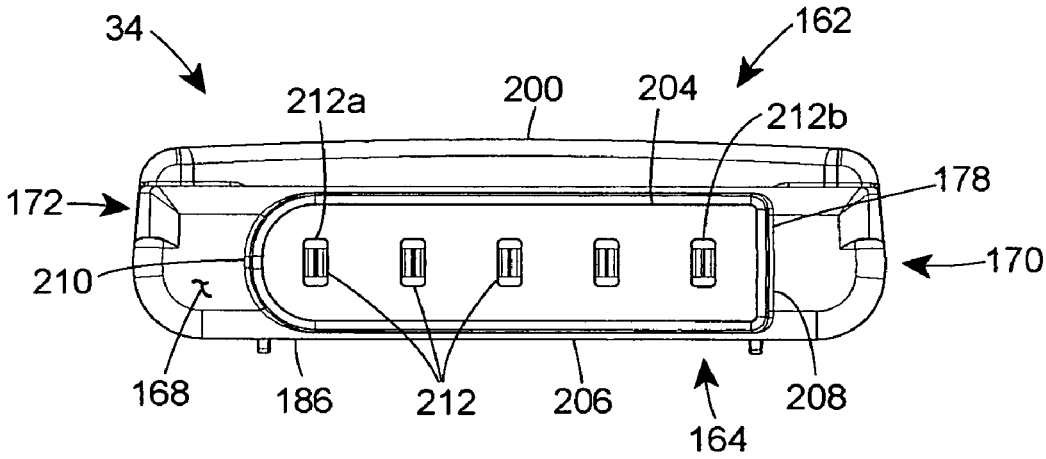
FIG. 10 is a back side view of the battery pack.
Figure 11:
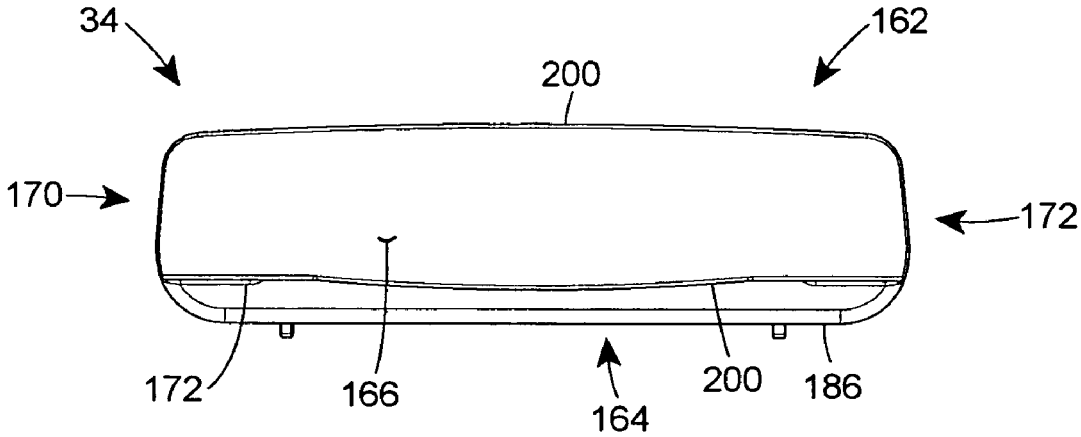
FIG. 11 is a front side view of the battery pack.

Referring now to FIGS. 1 and 4, the base 24 is disposed under the tank 26 and supports the tank 26 in an elevated condition when the base 24 is placed on a floor or other substrate. The base 24 includes a dolly 100, the battery pack 34, and a battery tray 102. The dolly 100 and the battery tray 102 combine to locate and support the battery pack 32 at the bottom side 22 of the vacuum cleaner 10.

The dolly 100 includes an outer wall 104 that can be generally circular and will usually have a similar shape and size as the side wall 40 of the tank 24. The outer wall 104 has a top edge 106 and a bottom edge 108. A bowl section 110 is disposed inside the outer wall 104 and connected to the outer wall 104 at the top edge 106. The bowl section 110 includes a ramped portion 112 and a bottom wall 114. The ramped portion 112 and the bottom wall 114 of the dolly 100 can be constructed to engage and support the bottom wall 38 of the tank 26. The bottom wall 114 of the dolly 100 can include holes 116 that are coaxial with the holes 42 of the bottom wall 38 of the tank 26 such that fasteners may be inserted through the holes 116 and into bosses 42 to fasten the base 24 to the tank 26. Other methods of permanent or releasable connection, such as welding, bonding, a snap fit, or the like, can be implemented.

The dolly 100 includes an opening 118 in the outer wall 104 that is sized and shaped to receive the battery pack 34. In this example, the dolly 100 includes a lip 120 extending outward from the outer wall 104 that defines the opening 118. The dolly 100 also includes an outlet housing 122 extending outward from the outer wall 104 and includes an outlet receptacle 124 that opens toward the top side 20 of the vacuum cleaner 10. The outlet receptacle 124 is sized and shaped to releasably receive the outlet 126. The outlet receptacle 124 can include a detent 128 to securely locate and maintain the outlet 126 (seen best in FIG. 2). The dolly 100 includes a plurality of posts 130 extending downward to the bottom side 22 of the vacuum 10. The plug 94 is removable from the outlet 126 such that when the lid assembly 28 and motor assembly 32 is removed from the tank 26, for instance in order to empty the tank 26 of debris, the power cord 92 can be unplugged and the combination can be completely detached from the tank 26.

The battery tray 102 includes a plurality of tubes 132 sized and shaped to receive the posts 130 of the dolly 100. The tubes 132 can fasten the battery tray 102 to the dolly 100 via a snap fit or other connection between the tubes 132 and the posts 130. The tubes 132 also include a footing 134. The footing 134 can bear on the substrate on which the vacuum cleaner 10 is placed or be used for connection to casters or wheels.

The battery tray 102 includes a bottom wall 136 and two side walls 138 to which the tubes 132 are connected. The bottom wall 136 and the two sidewalls 138 of the battery tray 102 and the bottom wall 114 of the dolly 100 combine to form a chamber 140 into which the battery pack 34 is disposed. Rails 142 can be placed on the bottom wall 136 of the battery tray 102 to help guide the battery pack 34 into the chamber 140.

The battery tray 102 can include an outlet chamber 142 that is sized and shaped to coordinate with the outlet receiver 122 of the dolly 100 when the battery tray 102 is fastened to the dolly 100. The outlet chamber 142 can mount and protect the outlet 126. In this example, the tubes 132 are connected to the sidewalls 138, and the outlet chamber 142 is disposed adjacent a sidewall 138, however, other configurations are possible.

An electrical connector assembly 144 is maintained in between the battery tray 102 and the dolly 100. In this example, the connector assembly 144 is fastened to the bottom wall 136 of the battery tray 102, however, other methods of attachment may be used. The connector assembly 144 includes an insulating block 146, and a positive terminal 148 and a negative terminal 150 both extending from the insulating block 146. A first positive wire 152 and a first negative wire 154 are connected to the positive terminal 148 and the negative terminal 150, respectively. The conductor assembly 144 further includes the outlet 126. A second positive wire 156 and a second negative wire 158 are connected to the outlet 126. In this example, the first positive wire 152 and the second positive wire 156 are connected, and the first negative wire 154 and the second negative wire 158 are connected. Both connections are made at a terminal block 160. The wires can also be joined by wire nuts or other structure or methods. In another example, only a single positive wire and a single negative wire connects the positive and negative terminals 148, 150 to the outlet 126.

Referring now to FIGS. 5-11, the battery pack 34 includes a top side 162, a bottom side 164, a front side 166, a back side 168, a left side 170, and a right side 172. The battery pack 34 includes a handle 174, a battery housing indicated generally at numeral 176, and a battery connector assembly 178. The handle 174 and the battery housing 176 are connected by extensions 180. A finger space 182 is disposed in between the handle 174 and the battery housing 176.

The housing 176 includes a top face 184 on the top side 162 and a bottom face 186 on the bottom side 164. A series of channels 188 are disposed on the top face 184 and the bottom face 186 of the housing 176. The channels 188 increase the surface area of the battery pack 34 to aid in heat transfer from the battery pack 34 to the atmosphere. The channels 188 also serve to increase the rigidity of the housing 176, and further can help locate the batteries within the battery pack 34. In one example not shown, slots 190 can be disposed in the channels 188 such that air may circulate from inside the battery pack 34 to outside of the battery pack 34. This circulation would further aid in heat removal from inside the battery pack 34. The slots could be disposed either in the sides of the channels 188 or the base of the channels 188.

At the intersection of the left side 170 and the top surface 184 is a first guideway 192. Further, at the intersection of the right side 172 and the top surface 184 is a second guideway 194. The first and second guideways 192, 194 engage guides in the dolly 100 while the battery pack 34 is being inserted into the chamber 140 to help guide the battery pack 34 into the chamber 140. A first detent 196 and a second detent 198 are disposed forward of the first guideway 192 and the second guideway 194, respectively. The detents 196, 198 can engage structure in the dolly 100 or the battery tray 102 such as spring loaded tabs (not depicted) to releasably secure the battery pack 34 in the chamber 140. The outer dimensions of the battery pack 34 can be only slightly less than the inner dimensions of the chamber 140 to ensure a snug fit. The battery pack 34 can be maintained in the chamber 140 by any other means known in the art.

The handle 174 of the battery pack 34 is disposed at the front side 166 and has a top surface 200 on the top side 162 and a bottom surface 202 on the bottom side 164. The top surface 200 of the handle 174 is in stepped relation to the top surface 184 of the housing 176, and the bottom surface 202 of the handle 174 is in stepped relation to the bottom surface 184 of the housing 176. The stepped relation of the handle 174 to the housing 176 allows for the handle 174 to substantially seal against the opening 118 in the outer wall 104 of the dolly 100 to provide a continuous, attractive appearance. It also allows a space for the user's fingers to reach underneath the handle 174 to grasp the battery pack 34 while inserting or removing the battery pack 34 from the chamber 140. The front side 166 of the battery pack 34 can be curved to generally match the outer wall of the dolly 100.

The battery connector assembly 178 extending outward from the back side includes opposing top and bottom walls 204, 206, and opposing left side and right side walls 208, 210. In this example, the right side wall 210 is curved, and the left side wall 208 is straight. The curvature of the right side wall 210 ensures that the battery pack 34 is inserted correctly into a charger, as will be seen. A series of slots 212 are disposed in the connector assembly 178 on the back side 168. The left most and right most slot 212*a*, 212*b* are adapted to receive the positive and negative terminals 148, 150 of the conductor assembly 144. The remaining slots 212 have functionality that will be described herein.

Figure 12:
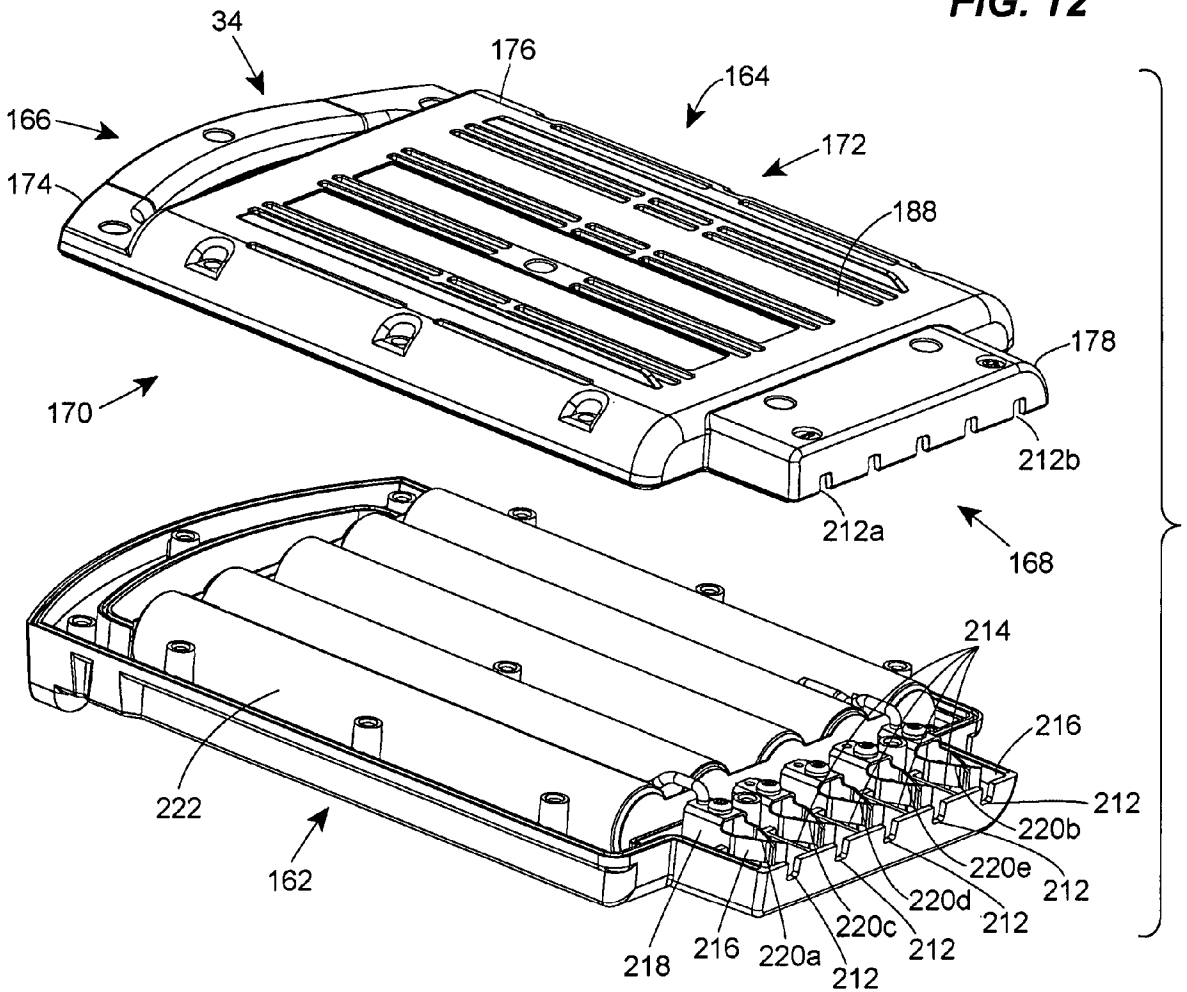
FIG. 12 is a perspective view of the battery pack with the cover removed.

Referring now to FIG. 12, a view of the battery pack 34 with its top removed is depicted. The connector assembly 178 includes a series of divider walls 214 that create separate chambers 216 in the connector assembly 178, with one slot 212 correlated to each chamber 216. A set of prong terminals 218 are disposed near the back side 168. Each prong terminal 218 includes a pair of prongs 220 extending to the back side 168 from the housing 176 into a respective chamber 216 and to a position adjacent a slot 212.

Inside the battery pack 34 is a plurality of batteries 222 in electrical connection. In this example, five rows of four batteries 22 are maintained in an electrical series with the prong terminal on the far left side, or left prong terminal 220*a*, and the prong terminal on the far right side, or right prong terminal 220*b*. The right prong terminal 220*b* is a positive terminal in this example, while the left prong terminal 220*a* is a negative terminal. The series connection is set up in standard fashion, with the negative side of the batteries 222 in direct contact with the positive side of the adjacent batteries 222, or the negative side of the batteries 222 connected to the positive side of the batteries 222 using an electrically conductive material. In this example, the battery pack 34 can maintain a voltage of 18 or 24 VDC, however, other voltages can easily be achieved by changing the number of batteries 222 or the voltage of each of the individual batteries 222.

The battery pack 34 also includes three center prong terminals 220*b*, 220*c*, 220*d* that are not used to conduct electricity. Instead, these prong terminals can be used to transmit information during the charging process, as will be described later.

In this example the chamber 140 is formed by the dolly 100 and the battery tray 102, however, other constructions can be used to releasably store the battery pack 34 and maintain the battery pack 34 with the tank 26. This includes a pair of rails, the use of magnetics, clips, cords, or any other structure known to releasably store an item. Further, the battery pack 34 could be stored in a chamber in the tank 26 itself, or any other part of the vacuum 10.

In this example, a majority of, and in fact the entirety of, the chamber 140 and battery pack 34 are shown to be disposed underneath both the bottom inner surface 50 and the bottom wall 38 of the tank 26. The low placement of the battery pack 34, in combination with its relatively thin but wide design, helps to maintain a low center of gravity for the vacuum 10, thus making the vacuum 10 more stable. The battery pack 34 could also be releasably located on the sidewall 42 of the tank 26. In this manner, the battery pack 34 would be more easily accessible for recharging and removal, but it would create a larger footprint for the vacuum 10. This construction would further raise the center of gravity and also pull the center of gravity away from the center of the tank 26. Thus, the vacuum 10 would be less stable as it is moved.

Figure 13:
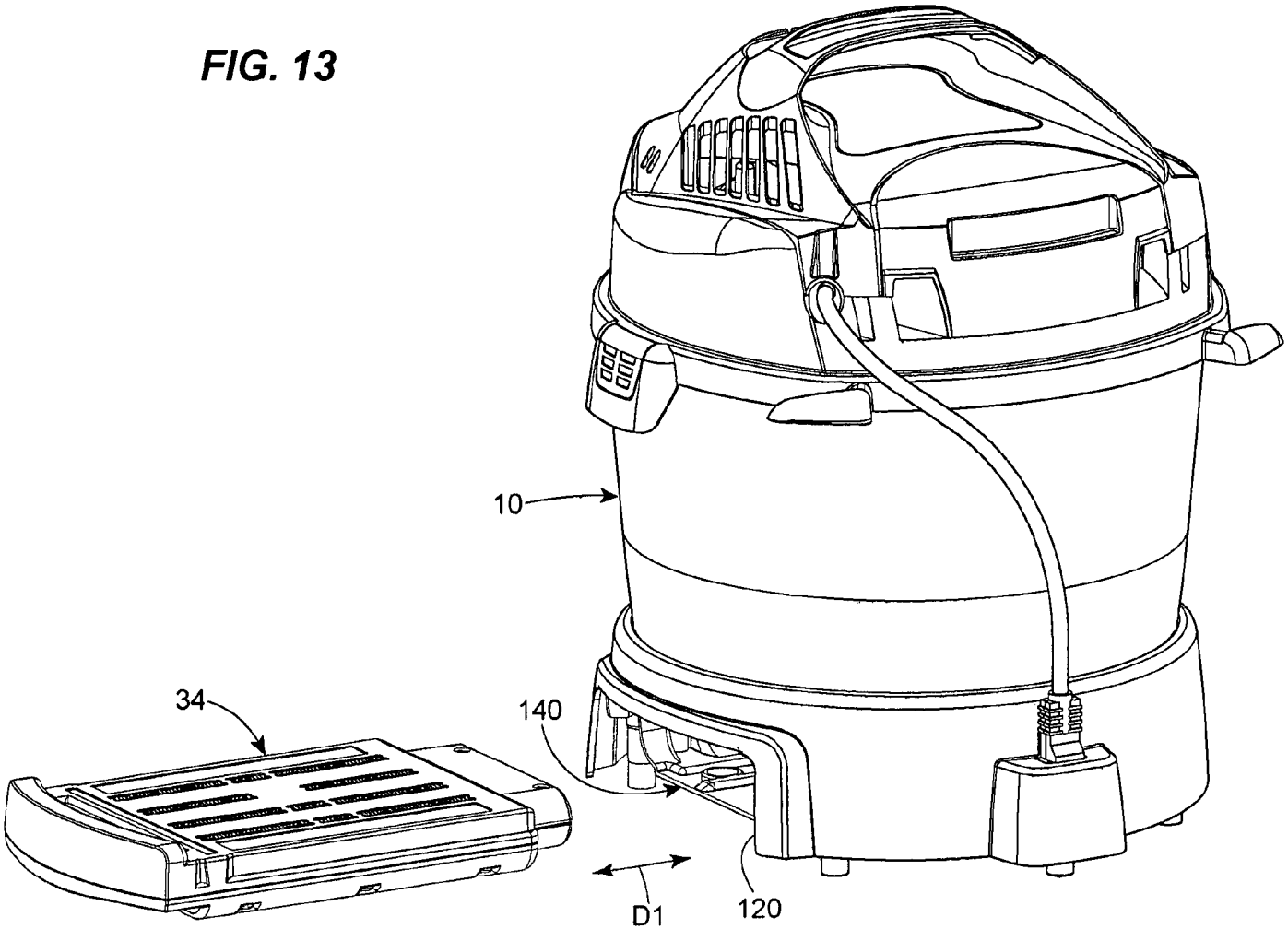
FIG. 13 is a perspective view of the vacuum cleaner of FIG. 1 with the battery pack detached.

Referring to FIG. 13, the battery pack 34 can be removed from and installed to the vacuum 10 simply by moving the battery pack 34 in the direction of arrow D1 through the dolly lip 120 and into and out of the chamber 140.

Figure 14:
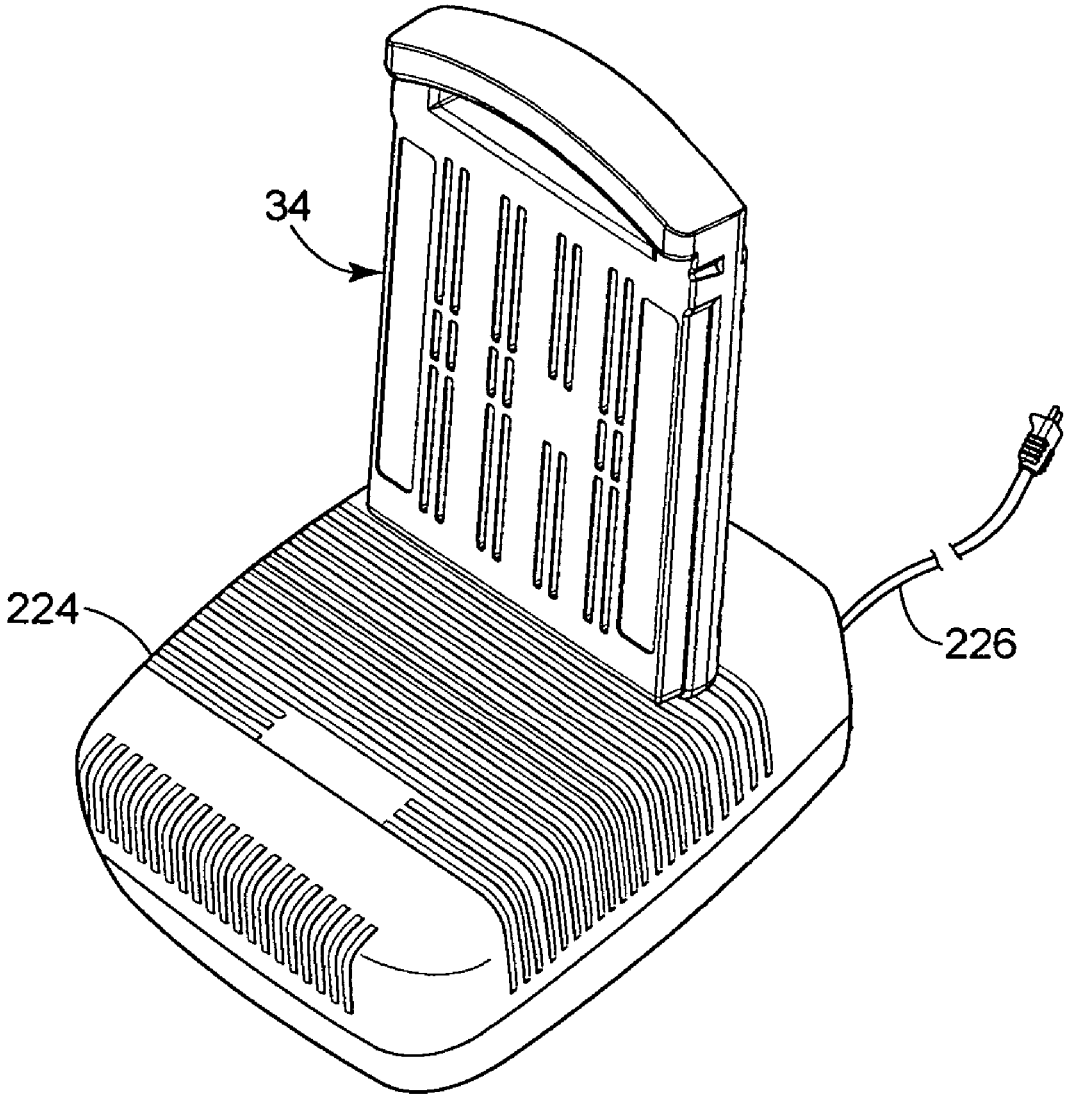
FIG. 14 is a perspective view of the battery pack mounted to a charging station.

Referring to FIG. 14, a charging station 224 can be used to recharge the battery pack 34. The charging station 224 can be plugged into any standard electrical outlet using cord 226 and can convert 120V AC power to 18 or 24 VDC power. The charging station 224 can include a plurality of ports (not shown) adapted to receive the prong terminals 218 of the battery pack 34. By inserting the prong terminals 218 into the ports, the charging station 224 can perform a quick-charge recharging of the battery pack 34. The center prongs 220*c*, 220*d*, 220*e* can provide information to the charging station 224 such as temperature to ensure that the quick charge is performed without damaging the batteries 222.

Other alternatives for recharging the batteries 22 may also be used. These include disposing a power converter within the battery pack 34 or elsewhere on the vacuum cleaner 10, so that the battery pack 34 and/or the vacuum cleaner 10 can be directly connected to a standard electrical outlet. A/C power supplied to the converter is converted to DC power and supplied to the battery pack 34. The battery pack 34 will generally store the DC power, but it can supply the DC power directly to the motor assembly 32. In this manner, if the battery power is low, the vacuum cleaner 10 can be plugged into an outlet and the battery power supplied to the battery pack 34 is immediately provided to the motor assembly 32. The batteries 222 within the battery pack 34 can be made from any known materials or hereafter discovered materials that are capable of rechargably storing DC power. This includes Ni—Cd, Lithium, etc. Further, a non-rechargeable battery could also be used, but would be less desireable for this type of application.

In use of the vacuum 10, the lid assembly 28 is disposed on the tank 26 to create at least a relatively air-tight seal. As is known, when the on/off switch 90 is placed in the on position, the motor 70 is energized and rotates the shaft 72, which rotates the impeller 76. A pressure differential is created across the impeller 76 due to its rotation, and air is pulled from the atmosphere and into the interior of the tank 26 through the inlet 44. The air then flows through the filter 56 and any debris is trapped inside the tank 22. The air then moves through the grid plate 60, across the impeller 76 in the impeller chamber 62 and is pushed out the outer perimeter of the impeller 76 to the annular chamber 68 and into the blower chamber 80. From the blower chamber 80, the air can be directed out to the atmosphere in any of the previously mentioned structures, i.e. slots 82, a port 86, vents 84, or other structures known in the art. Details of a similar air flow through the housing are shown in U.S. Pat. No. 6,530,116, which is incorporated herein by reference. The vacuum 10 may be transported anywhere free of the encumbrance of a cord connected to an outlet on the wall. Once the power is drained from the battery pack 34, the battery pack 34 can be removed from the vacuum 10 and placed in the charging station 224 to recharge the batteries 222. After recharging is complete, the battery pack 34 may be inserted back into the chamber 140 into contact with the conductor assembly 144 to provide power to the motor assembly 32.

The use of a detachable rechargeable battery pack 34 in conjunction with the motor assembly 32 provides several benefits. The vacuum 10 is self-contained, and can be placed and used anywhere on a shop floor or outside irrespective of power outlets. No power cords limit the travel of the vacuum 10. The vacuum 10 does not rely on a gas powered motor assembly, which can be extremely loud indoors.

If the battery pack 34 is placed underneath the bottom inner surface 50 of the tank 26, the entire vacuum 10 is physically stabilized. The center of gravity of the vacuum 10 is lowered due to the concentrated weight of the battery pack 34 near the bottom of the vacuum 10 so that it is less prone to tipping.

In one example, the tank can have a capacity of 2.5 gallons, which is comparatively small and easy to carry relative to current vacuums designed for shop floor environments. Because it is small and battery powered, it is easily transportable by hand to any location that may need cleaning without consideration of an electrical wall outlet. The utility of the vacuum is therefore greatly enhanced.

Figure 15:
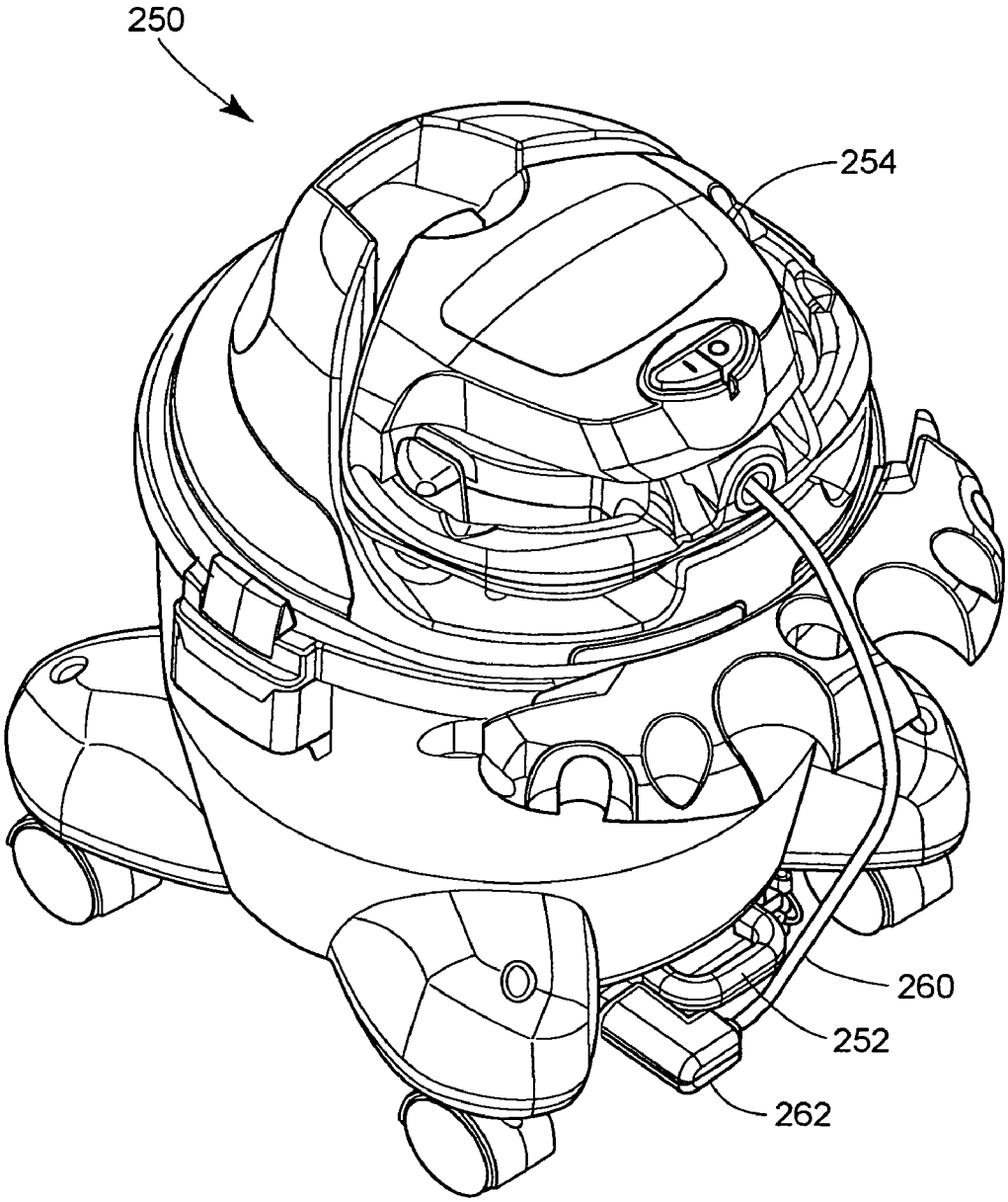
FIG. 15 is a perspective view of a second example of a vacuum cleaner.
Figure 16:
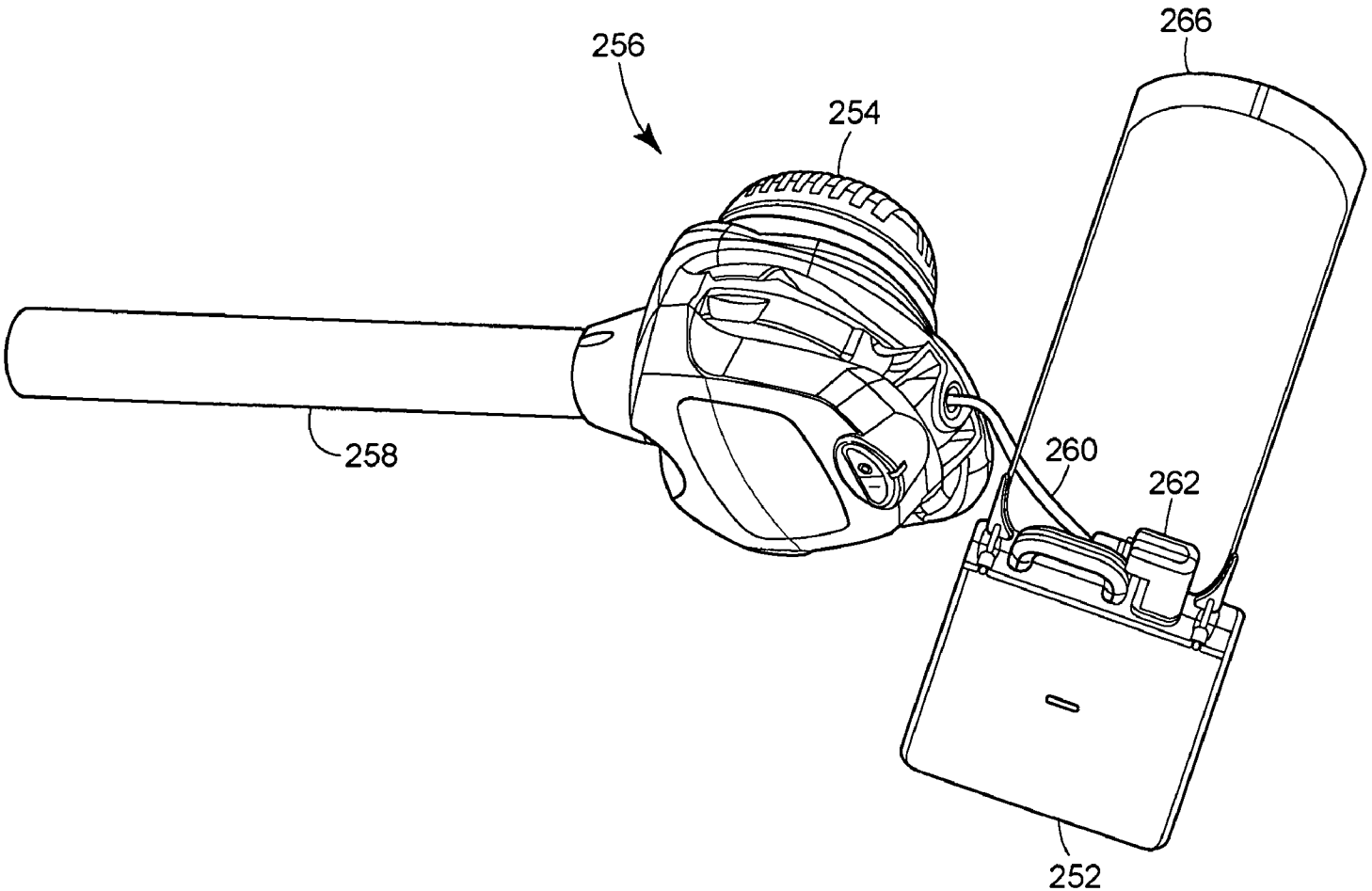
FIG. 16 is a perspective view of the motor assembly and battery pack detached from the vacuum cleaner of FIG. 15.
Figure 17:
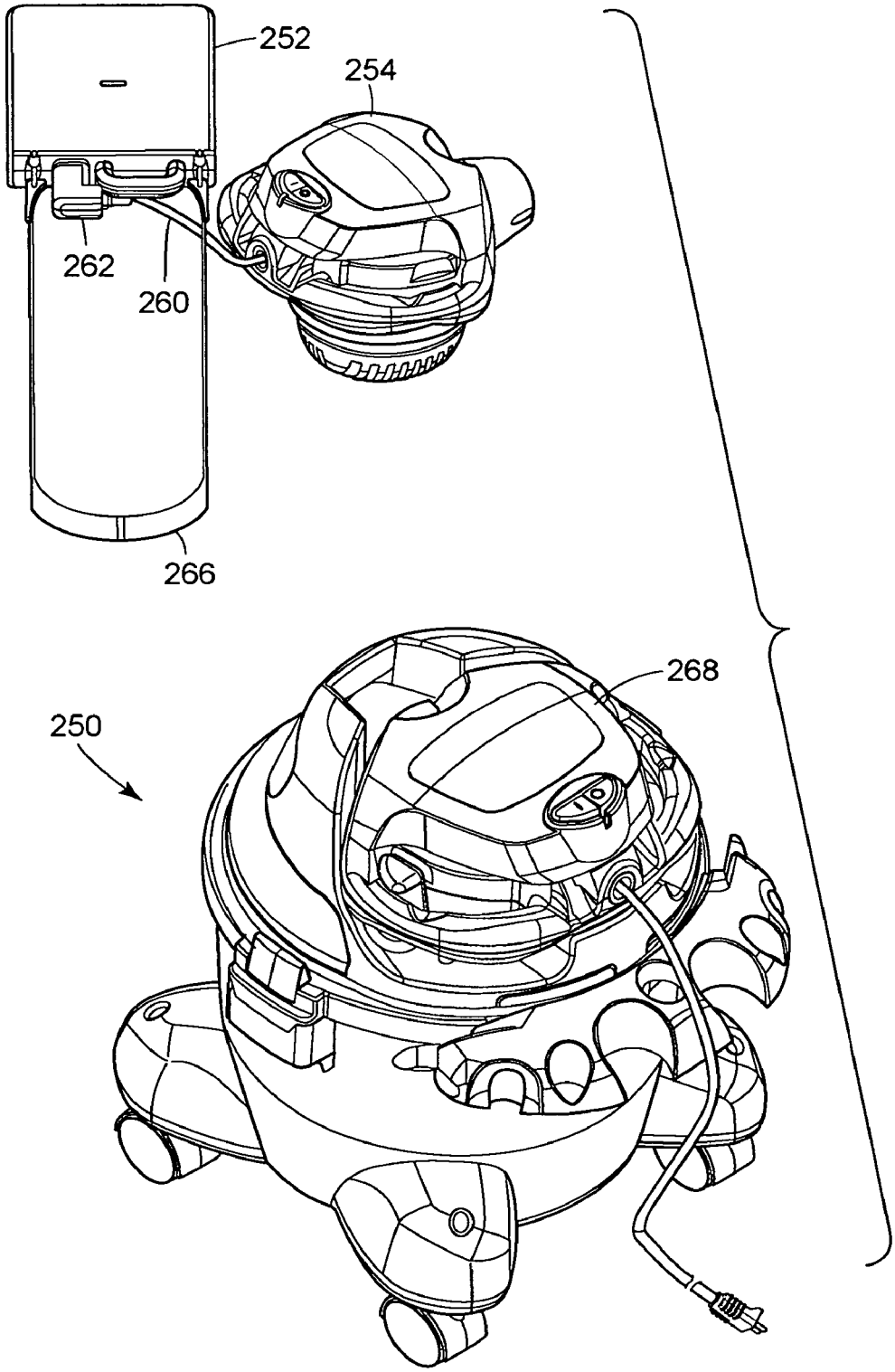
FIG. 17 is a perspective view of the motor assembly and battery pack detached from the vacuum cleaner of FIG. 15 with a second motor assembly attached to the vacuum cleaner.

A second example of a vacuum cleaner 250 is depicted in FIGS. 15, 16, and 17. In this example, a battery 252 and a motor assembly 254 may be removed from the vacuum cleaner 250 to form a portable blower assembly 256. A tube 258 can be attached to the motor assembly 254 to provide a directed airflow out of the motor assembly 254. Details of a typical vacuum cleaner with a detachable blower are shown in U.S. Pat. No. 6,530,116, which is incorporated by reference herein.

In the depicted example, the motor assembly 254 includes a cord 260 with a plug 262. The plug 262 is disposed in an outlet 264 that is mounted in the battery 252. The battery 252 can include a strap 266 to improve its transportability.

When the motor assembly 254 is removed from the vacuum cleaner 250, a second motor assembly 268 may be mounted to the vacuum cleaner 250 (FIG. 17). In the shown example, the second motor assembly 268 can be directly plugged into a standard electrical wall outlet. Thus, the first motor assembly 254 can be powered by direct current, and the second motor assembly 268 can be powered by alternating current.

Figure 18:
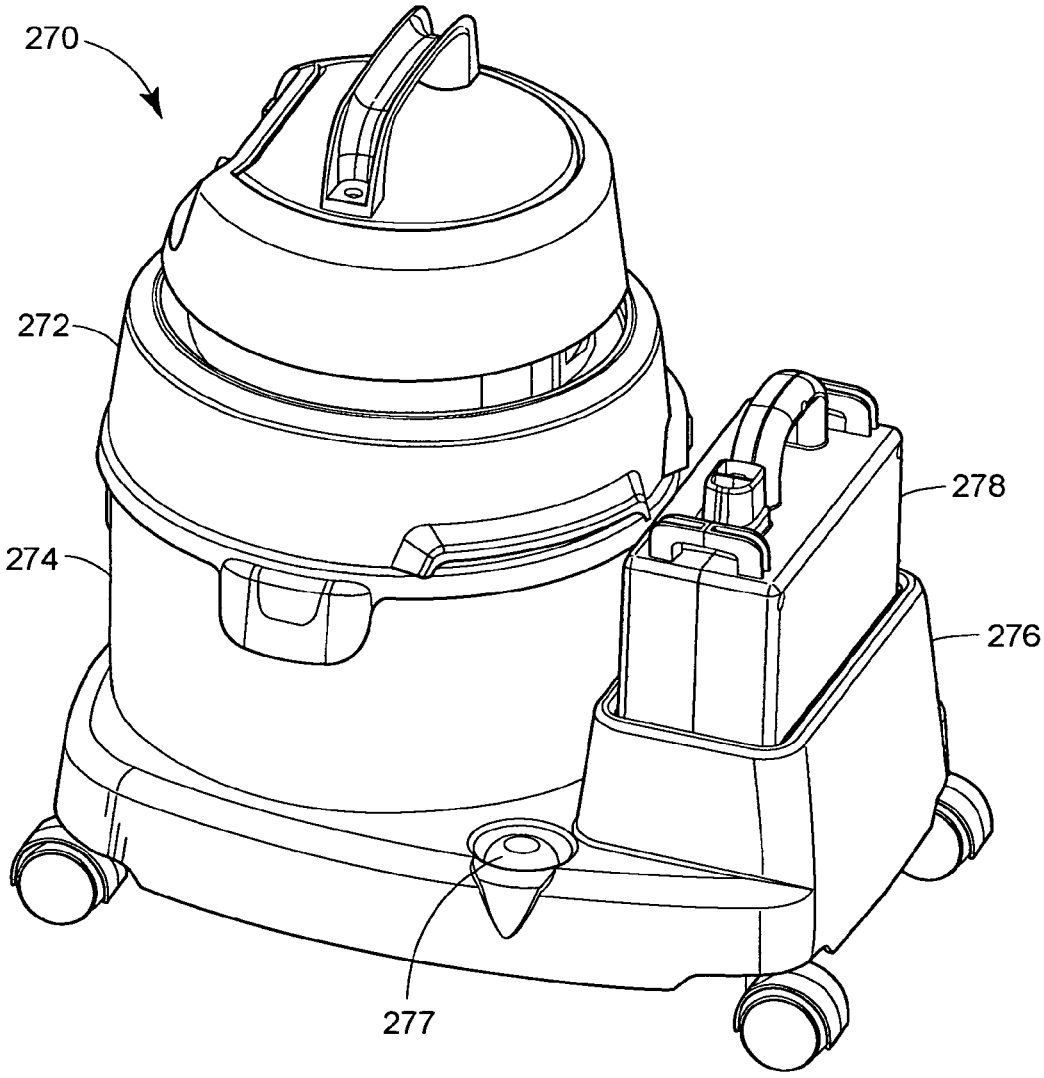
FIG. 18 is a perspective view of a third example of a vacuum cleaner.

FIG. 18 is a perspective view of a third example of a vacuum cleaner 270. The vacuum cleaner 270 includes a tank 272 disposed on a base 274. The base 274 extends out from the tank 272 and includes a mounting station 276 and a tool mount 277 that may receive any number of tools, including brushes, brooms, and the like.

The mounting station 276 is designed such that a battery 278 may be inserted into the mounting station 276 in a downward manner. The mounting station 276 may include structure as depicted and described in reference to the first example such that power from the battery 278 is transferred to a motor assembly (not shown). In this example, the insertion of the battery 278 is aided by gravity, and is mounted at a comparatively higher elevation. However, the footprint is enlarged and the benefits of the first example with respect to the stability of the unit are not as great.

From the foregoing, one of ordinary skill in the art will appreciate that the present disclosure sets forth a battery powered vacuum cleaner that is convertible to a portable blower. However, one of ordinary skill in the art could readily apply the novel teachings of this disclosure to any number of situations. As such, the teachings of this disclosure shall not be considered to be limited to the specific examples disclosed herein, but to include all applications within the spirit and scope of the invention.

We claim:

1. A vacuum cleaner that has:

a tank that has a bottom and an inlet for receiving debris;

a base;

a motor assembly that is disposed adjacent to the tank and is adapted to draw debris into the tank through inlet;

a battery pack that is disposed, in the base, adjacent to the bottom of the tank;

a connection from the battery pack to the motor assembly that is adapted to carry current between the battery pack and the motor assembly;

at least one battery in the battery pack that supplies power to the motor assembly;

a conductor assembly mounted in the base; and a cable that extends from the conductor assembly to an outlet receptacle in the base and terminates at an outlet in the outlet receptacle.

2. The apparatus of claim 1, wherein at least one battery of the battery pack is rechargeable.

3. The apparatus of claim 1, wherein the connection from the battery pack to the motor assembly includes a cord at least in part connecting the battery pack to the motor assembly.

4. The apparatus of claim 1, wherein the battery pack is detachably disposed adjacent to the tank.

5. The apparatus of claim 1, further comprising a battery charger adapted to receive and recharge the battery.

6. The apparatus of claim 1, further comprising a base disposed under the tank and supporting the tank, the battery being detachably disposed in the base.

7. The apparatus of claim 6, the base further comprising a dolly and a tray, the battery slidably received in the tray beneath the dolly.

8. The apparatus of claim 1, further comprising a second cord with a first end extending from the motor assembly and terminating in a plug at a second end, the plug being releasably disposable in the outlet.

9. A vacuum cleaner that is adapted to be powered by a battery pack and has:

a tank that has an inlet opening;

a motor that is disposed in fluid communication with the tank and draws air into the tank through the inlet opening;

a conductor assembly that has an insulating bar and first and second prongs that extend from the insulating bar;

a cord that extends from the insulating bar on a first end, terminates at an outlet on a second end, and at least in part electrically connects the conductor assembly to the motor; and a tray that is positioned adjacent to the bottom of the tank and the conductor assembly, has a longitudinal axis, and is adapted to slidably receive a battery along its longitudinal axis such that the battery is in electrical communication with the conductor assembly and supplies electrical power to the motor through the cord.

10. The apparatus of claim 9, further comprising a second cord extending from the motor at a first end and terminating at a plug at the second end, the plug adapted to be received by the outlet.

11. The apparatus of claim 9, the tray including an outlet receiver adapted to secure the outlet.

* * * * *